United States Patent [19]

Voigt, Jr.

[11] 4,284,442

[45] Aug. 18, 1981

[54] CASTABLE TNT COMPOSITIONS CONTAINING A BROAD SPECTRUM PREFORMED THERMOPLASTIC POLYURETHANE ELASTOMER ADDITIVE

[75] Inventor: H. William Voigt, Jr., Stanhope, N.J.

[73] Assignee: The United States of America as represented by the Secretary of the Army, Washington, D.C.

[21] Appl. No.: 66,598

[22] Filed: Aug. 14, 1979

Related U.S. Application Data

[63] Continuation of Ser. No. 885,716, Mar. 13, 1978, abandoned.

[51] Int. Cl.[3] ..... C06B 45/10

[52] U.S. Cl. ..... 149/19.4; 149/18; 149/92; 149/105

[58] Field of Search ..... 149/19.4, 92, 105, 18

[56] References Cited

U.S. PATENT DOCUMENTS

| | | | |
|---|---|---|---|
| 2,871,218 | 1/1959 | Schollenberger | 525/440 |
| 3,447,980 | 6/1969 | Voigt | 149/19.4 |
| 3,507,722 | 4/1970 | Hamrick | 149/19.4 |
| 3,619,306 | 11/1971 | Berthmann et al. | 149/105 |
| 3,706,609 | 12/1972 | Voigt et al. | 149/105 |
| 3,745,076 | 7/1973 | Sickman et al. | 149/105 |
| 3,778,319 | 12/1973 | Benzinger | 149/19.4 |
| 3,798,090 | 3/1974 | Allabashi | 149/19.4 |
| 4,011,114 | 3/1977 | Allabashi | 149/19.4 |
| 4,012,245 | 3/1977 | Voigt et al. | 149/19.4 |

FOREIGN PATENT DOCUMENTS 1249038 10/1971 United Kingdom .

OTHER PUBLICATIONS

Hawley, "The Condensed Chemical Dictionary", 9th Ed., p. 315, Van Nostrand Reinhold Co. (1977) New York.

Berthmann et al., *Chem. Abs.*, 82, abs. #158368d (1975).

Lingens, *Chem. Abs.*, 77, abs. #127580j (1972).

*Primary Examiner*—Edward A. Miller

*Attorney, Agent, or Firm*—Nathan Edelberg; Robert P. Gibson; A. Victor Erkkila

[57] ABSTRACT

Castable high explosive compositions of generally improved physical characteristics consist essentially of 2,4,6-trinitrotoluene (TNT) and about 0.05 to 10% by weight of the TNT of a thermoplastic polyurethane elastomer, which is soluble in the trinitrotoluene and is fully reacted, i.e. contains essentially no free isocyanate groups, prior to incorporation thereof in the explosive composition.

9 Claims, No Drawings

CASTABLE TNT COMPOSITIONS CONTAINING A BROAD SPECTRUM PREFORMED THERMOPLASTIC POLYURETHANE ELASTOMER ADDITIVE

GOVERNMENTAL INTEREST

The invention described herein may be manufactured, used and licensed by or for the Government for governmental purposes without payment to me of any royalty thereon.

This is a continuation of application Ser. No. 885,716, filed Mar. 13, 1978, abandoned.

BACKGROUND OF THE INVENTION AND PRIOR ART STATEMENT

Explosive compositions containing technical grade 2,4,6-trinitrotoluene (TNT) are often cast into artillery shells, rockets, bombs, etc. by heating the composition to melt the TNT and then pouring the melt into the shell where it is allowed to cool and solidify. Cast changes thus obtained usually exhibit undersirable properties, such as exudation of oily impurities on storage, voids, poor compressive strength, brittleness, lack of homogeneity due to oriented crystal structure of the TNT, etc., which adversely affect ballistic performance and impact sensitivity. Various methods have been proposed to overcome such undesirable properties, but they have been only partially successful. For example, British Pat. No. 1,249,038 discloses that a fine crystalline cast charge of TNT having random crystal structure can be obtained by incorporating a small amount of hexanitrostilbene into the molten composition. However, the hexanitrostilbene is not effective for overcoming other deficiencies, such as brittleness, exudation, etc. Various additions to the molten TNT composition have been proposed to produce solid casts possessing increased resistance to exudation and cracking, e.g. high polymers soluble in the explosive, specifically poly (methylmethacrylate), polymethacrylate, and poly (isopropenyl methyl ketone) (West German Pat. No. 1646278, West German Offen. No. 2100030). U.S. Pat. No. 3,706,609 discloses that cast TNT explosives, which are free from exudation and voids and can be remelted and recast while retaining good homogenity, can be obtained by adding a thermoplastic cellulosic resin like nitrocellulose to the melt. However, the resulting cast charges are relatively brittle and possess relatively poor mechanical strength and adhesion to the artillery shell. U.S. Pat. No. 3,447,980 discloses the production of cast TNT explosives, which are essentially free from exuding oils and voids, are less brittle and possess superior compressive strength and adhesion to the case, by incorporating into the molten explosive composition a polyurethane elastomer producing system consisting of a prepolymer from 2,4-tolylene diisocyanate and 1,4-polybutylene glycol plus a curing agent. However, the molten explosive compositions have limited pot life before gellation and irreversible chemical curing of the polyurethane elastomer takes place; and the solidified compositions when remelted separate into a liquid TNT phase and a solid insoluble elastomer phase and hence cannot be reprocessed to produce a composition of constant explosive characteristics. U.S. Pat. No. 4,012,245 discloses the production of cast TNT explosive compositions, which are essentially free from oily exudation on storage and voids and can be remelted and resolidified essentially without loss of homogeneity and explosive properties, by incorporating in the molten explosive composition a small amount of a polyurethane elastomer-producing system consisting of an organic polyisocyanate, a hydroxyl-terminated 1,4-butadiene polymer liquid resin and an abietyl alcohol.

The polyurethane elastomer producing systems employed according to the foregoing patents are relatively complex and require the reaction in the molten TNT composition of a compound containing free isocyanate groups with a compound containing free hydroxyl groups. However, the presence of moisture in these systems must be avoided, since the water can react rapidly with the isocyanate groups to form gaseous carbon dioxide, causing inter alia the formation of harmful voids in the solidified cast. Such moisture can be introduced into the explosive composition in various ways and its complete removal can be difficult if not impossible. For example, in the manufacture of Composition B, consisting of 60% RDX and 40% TNT (plus added wax desensitizer), the RDX crystals mixed with the TNT may contain adherent moisture due to incomplete drying of the crystals after washing with water. Further, while such polyurethane producing systems are effective for overcoming some of the deficiencies of cast TNT compositions, they must be employed in conjunction with other additives to reduce or eliminate other shortcomings. Thus, it appears that prior to the present invention no single, broad spectrum additive had been proposed for treating the many problems associated with cast TNT charges.

SUMMARY AND DETAILED DESCRIPTION OF THE INVENTION

A principal object of the present invention is to provide a single, broad spectrum additive to castable TNT compositions, which is effective for mitigating or eliminating most or all of the aforementioned deficiencies of the prior art castable TNT compositions.

Other objects will become apparent from the following description of the invention.

In accordance with this invention it has been unexpectedly found that these objects can be accomplished by incorporating into the castable TNT composition about from 0.05 to 10%, based on the weight of the TNT, of a thermoplastic polyurethane elastomer, which is soluble in the TNT and is fully reacted, i.e. contains essentially no free isocyanate groups, prior to incorporation in the castable TNT composition. While the castable TNT composition into which the additive is incorporated can consist wholly (100%) of TNT, the preferred explosive compositions of this invention are those wherein up to 80%, particularly from 40% to 80%, by weight of the TNT is replaced by at least one crystalline high explosive selected from the group consisting of 1,3,5-trinitro-1,3,5-triazacyclohexane (RDX) and 1,3,5,7-tetranitro-1,3,5,7-tetraazacyclooctane (HMX).

The following examples provide specific illustrations of the explosive compositions of the present invention. The parts in the examples are parts by weight.

EXAMPLE 1

Preparation of Elastomer Coated RDX

A lacquer of Estane was prepared by dissolving 3 parts of Estane 5702 in 40 parts of methyl ethyl ketone. Estane 5702 is believed to be a thermoplastic, essentially fully reacted polyurethane elastomer containing essentially no free isocyanate groups, prepared from 4,4'-diphenylmethane diisocyanate, poly (tetramethyleneadipate) glycol and 1,4-butanediol, manufactured by the B. F. Goodrich Co. Estane 5702 has the following physical properties:

| PHYSICAL PROPERTIES | TYPICAL VALUE[1] | ASTM TEST PROCEDURE |
|---|---|---|
| Specific Gravity | 1.20 | D-792 |
| Hardness, Durometer A | 70 | D-2240[2] |
| Tensile Strength (psi) | 3500 | D-882[3] |
| Modulus @ 300% Elongation (psi) | 400 | |
| @ 100% Elongation (psi) | 200 | |
| Elongation (%) | 625 | |
| Graves Tear (lbs/in) | 175 | D-1004 |
| Tear Propagation (lbs/in) | 130 | |
| Low-Temperature Brittleness Point (°C.) | < −70 | D-746[2] |
| Gehman Low-Temperature Freeze Point (°C.) | −31 | D-1053[2] |
| Solution Viscosity (15% TS in Methyl Ethyl Ketone, Brookfield RVF Viscometer No. 2 Spindle, 20 rpm, 25° C.), cps | 180–290 | [4] |

[1]Representative solution cast film data on typical production material.
[2]Test conducted on 75 mil tensile sheets.
[3]Test conducted on dumbbell film samples.
[4]Actual specification value.

The Estane lacquer was stirred into a slurry of 97 parts of RDX, Class A, average particle size about 175 microns, in 100 parts of distilled water containing 0.1 part of polyvinylpyrrolidone of m.w. 90,000. 300 Parts of cold water (8° C.) were added with agitation to the mixture thus obtained, thereby cooling the mixture to 14° C. and precipitating the Estane as a coating on the finely divided RDX. The precipitate was separated by filtration and the filter cake was washed with two portions each of 100 parts of cold water (8° C.) and dried on a tray at 100° C. The dry, coated RDX was obtained as free-flowing granules of bulk density 0.62 gr/cc.

B. Preparation of the Cast Explosive 40 parts of technical grade TNT (solidification point 80.2° C.) were heated with agitation to 85°–90° C. 60 parts of the product obtained in A, comprising 58.2 parts of RDX coated with 1.8 parts of Estane 5702, were preheated to 90° C. and stirred into the molten TNT. The resulting mixture was agitated at 85°–90° C. for several minutes until the RDX was uniformly dispersed, and then poured into cylindrical containers and allowed to solidify.

The melt possessed satisfactory viscosity and pourability and maintained excellent homogeneity with no visible settling of the RDX.

The solidified cast product thus obtained possessed excellent homogeneity, heat stability and freedom from exudation, viz. 0.05% exudation after 5 days at 70° C. versus 0.18% exudation under similar condition when the Estane was omitted. Other advantageous properties imparted to the cast explosive by the Estane includes the following:

(1) The Estane modified solid TNT matrix was characterized by highly desirable fine, random oriented TNT crystals similar to that obtained when hexanitrostilbene additive is employed.

(2) The cast was free from cracks and voids, showed excellent bonding of the RDX crystals to the TNT matrix, and excellent bonding of the cast to the shell liner.

(3) The compressive strength of the cast was almost doubled. This is particularly important for shaped charge explosive casts for use in rockets.

(4) The cast was non-brittle at temperatures down to −40° C.; it yielded flexible, non-brittle shavings.

(5) The cast possessed substantially better impact resistance. The Estane eliminated the need for the wax desensitizer conventionally employed.

(6) The cast could be remelted and resolidified for reuse without loss of homogeneity and explosive properties. No noticeabe RDX settling occurred when the cast products were remelted and allowed to stand in liquid state several hours.

(7) No special conditions are necessary to eliminate the presence of moisture during the melting, pouring and casting of the explosive composition as is required when prior art polyurethane elastomer producing systems are employed, wherein a compound containing free isocyanate groups is reacted in the molten TNT explosive composition, such as disclosed in U.S. Pat. Nos. 3,447,980 and 4,012,245.

Similar results were obtained by replacing Estane 5702 with Plastothane TM 430, which is said to be a fully reacted polyurethane elastomer containing no free isocyanate groups having the following physical properties:

| | |
|---|---|
| specific gravity | 1.22 |
| hardness, Shore A (initial/10 sec.) | 95/95 |
| typical viscosity, centpoises (15% solution in methyl ethyl ketone) | 1375 |
| ultimate tensile, psi (Kg/cm$^2$) | 4450 (313) |
| ultimate elongation, % | 600 |

Plastothane 430 is manufactured by the Thiokol Chemical Corp. and is believed to be the reaction product of a poly (caprolactone) glycol of average molecular weight within the range 500–2000 and 4,4'-diphenylmethane diisocyanate.

EXAMPLE 2

Composition B, a mixture of 60 parts RDX, 40 parts TNT and 1 part wax, was heated to 85°–90° C. until the TNT was completely melted. The wax separated as a supernatant layer on the melt and side of the container. 0.12 Part of Estane 5702 was added to the melt with agitation and the resulting mixture was agitated at 85°–90° C. for about 30 minutes. The incorporation of the Estane unexpectedly eliminated the wax segregation from the melt. The melt was poured into molds and allowed to cool and solidify. The solid cast explosive composition thus obtained possessed similar properties to those of the cast product of example 1.

The control cast Composition B (containing no Estane additive) contained an oriented structure of large TNT crystals.

The following table compares the fragment impact sensitivity of the cast products obtained above as well as of pressed Composition B. The fragment impact test was conducted on unconfined, approximately 70 gram billets of explosive composition. The fragment was a ½"×½" diameter brass cylinder. Ten shots were obtained at a fragment velocity which resulted in no explosion of the explosive billet (U.S. Manual of Sensitiveness Impact Series Test 01; Fragment Impact Test TTCP Panel).

| | Minimum Velocity to cause explosion ft/sec | Maximum Velocity for no explosion ft/sec |
|---|---|---|
| Composition B (60/40/1 RDX/TNT/wax) pressed billet | 2972 | 2856 |
| Composition B cast billet | typical range of results* | 2700–3300* |
| Composition B + 0.12% Estane cast billet | 3080 | 3037 |

*The wax employed as a desensitizer, unlike Estane 5702, is insoluble in the TNT and hence products cast product of varying uniformity and explosive properties.

EXAMPLE 3

The following example illustrates the use of fibrous alpha cellulose powder in conjunction with the novel thermoplastic polyurethane additive to further increase the cast strength, which is highly important to prevent base cracking.

Cast explosive charges were prepared by incorporating Estane 5702, alone or together with alpha cellulose powder, into a mixture of 60 parts RDX and 40 parts TNT at 85°–90° C., agitating the resulting composition at 85°–90° C. until homogeneous and pouring the molten composition into molds wherein it was allowed to cool and solidify.

Control compositions were similarly prepared by employing standard wax in place of Estane 5702.

The following table compares the compressive strength of the cast charges obtained in the foregoing manner.

| Additive to 60/40 RDX/TNT | Compression Strength at 70° F. (½ in. × ½ in. cylinders) psi |
|---|---|
| 1% Wax | 436 |
| 1% Wax + 0.24% α-cellulose(1) | 911 |
| 1% Estane 5702 | 977 |
| 1% Estane 5702 + 0.24% α-cellulose(1) | 1117 |
| 1.8% Estane 5702 | 1049 |
| 1.8% Estane 5702 + 0.24% α-cellulose(1) | 1318 |

(1)The αcellulose used was finely divided-cellulose made from wood pulp and marketed by the Brown Co. under the trade name Solka-Floc, grade SW-40 having the following properties: average fiber length, 100–140 microns; apparent density range, 6–12 lbs. per cu. ft.; pH, 10% aqueous suspension, 5.5–6.5

A substantial increase in compressive strength of the cast was also obtained by replacing the α-cellulose in the foregoing example with carbon black, marketed by Cities Service Co. under the tradename Peerless 155 Carbon Black, having an average particle diameter of 22 millimicrons and a surface area of 130 sq. meters/gram.

The polyurethane additive of the invention can be incorporated in the TNT compositon in any suitable manner, e.g. by addition to the molten TNT directly or by precoating it on the particulate TNT, RDX and/or HMX and mixing the precoated explosive with the molten TNT. The coating operation can be accomplished by known methods, e.g. by mixing the particulate RDX etc. with an aqueous emulsion of the polyurethane additive or with a solution of the polyurethane additive in a suitable solvent, such as methylene chloride or methyl ethyl ketone, and removing the carrier liquid e.g. by evaporation. The molten TNT composition containing the polyurethane additive, with or without other additives, is agitated at a suitable temperature, e.g. 85°–90° C., until homogeneous and poured into containers, e.g. artillery shells, and allowed to cool to a solid. It has been found that the preformed polyurethane elastomer additives used in the present invention are generally soluble in the TNT. If desired, small amounts of other substances, e.g. 0.5 to 2% by weight based on the TNT content, can be incorporated in the molten TNT to further modify the physical properties of the cast compositions in known manner, e.g. nitrocellulose, nitrotoluene, organic plasticizers, liquid polymeric resins such as epoxy resins and poly alpha methylstyrene.

To achieve a solid cast TNT explosive composition possessing a fine random oriented TNT crystal structure and other advantageous properties noted above, it is preferred to incorporate about from 0.05% to 10% and especially from 0.1% to 5% by weight of the preformed, fully reacted thermoplastic polyurethane additive, such as Estane, based on the TNT content of the explosive composition. The incorporation of substantially more than 10% of the polyurethane additive by weight of the TNT is less preferred, since it dilutes the explosive power, increases the melt viscosity excessively and produces a cast product, which although characterized by the fine random TNT crystal structure, tends to break along massive cleavage planes when subjected to breaking.

Any preformed thermoplastic solid polyurethane elastomer, which is full reacted, i.e. contains essentially no free isocyanate groups, and is soluble in TNT, is suitable for use in the present invention. Polyurethanes are generally described as the reaction products of organic di- or polyisocyanates and di- or polyfunctional alcohols, including long chain polyethers and polyesters. Suitable di- or polyisocyanates include aromatic diisocyanates such as 2,4-toluene diisocyanate, 4,4'-diphenylmethane diisocyanate, and 4,4'-biphenyldiisocyanate, and aliphatic diisocyanates, such as 1-methyl-2,4-cyclohexane diisocyanate and 1,6-hexamethylene diisocyanate. Suitable bi- or poly functional alcohols include hydroxy terminated polyethers of alphatic glycols, e.g. poly (ethyleneoxide) glycol, poly (1,2-propylene oxide) glycol, and poly (tetramethylene oxide) glycol, and hydroxy terminated polyesters of aliphatic glycols, e.g. poly (tetramethyleneadipate) glycol, poly (hexamethylenecarbonate) glycol as well as poly (caprolactone) glycols. Poly (caprolactone) glycols can be formed by controlled polymerization and ring opening of epsiloncaprolactone to yield a primary hydroxyl terminated polymer containing the following repeating unit $-\!\!\left[(CH_2)_5COO\right]\!\!-_n$. Such poly (caprolactone) glycols of average molecular weight ranging from about 500 to 2000 are marketed under the tradename NIAX® Caprolactone Polyols by the Union Carbide Corp. Preferred polyurethane elastomers for use in this invention are the reaction products of a hydroxy terminated polyester of a saturated aliphatic glycol of from 4 to 10 carbon atoms and a dicarboxylic acid (or anhydride) of the formula HOOC—R—COOH wherein R is an alkylene radical of 2 to 8 carbon atoms, a diphenyl diisocyanate and a saturated aliphatic glycol of 4 to 10 carbon atoms, such as are described in U.S. Pat. No. 2,871,218. The long chain di- or poly functional alcohols can be used in conjunction with short chain diols, e.g. 1,4-butanediol. Particularly effective and desirable thermoplastic elastomers are the reaction products of poly (tetramethyleneadipate) glycol, 1,4-butanediol and 4,4'-diphenylmethane diisocyanate of the type disclosed in U.S. Pat. No. 2,871,218.

The foregoing disclosure is merely illustrative of the principles of this invention and is not to be interpreted in a limiting sense. I wish it to be understood that I do not desire to be limited to the exact details of construction shown and described, because obvious modifications will occur to a person skilled in the art.

I claim:

1. A castable explosive composition consisting essentially of 2,4,6-trinitrotoluene (TNT) and about from 0.05 to 10% by weight, based on the TNT content of the explosive composition, of a thermoplastic polyurethane elastomer, which is dissolved in the TNT and is the reaction product of an organic diisocyanate and a hydroxy terminated polyester or a hydroxy terminated polyether containing essentially no free isocyanate groups prior to incorporation thereof in the explosive composition.

2. A castable explosive composition according to claim 1, which consists essentially of

20–100% TNT

0–80% of at least one particulate crystalline high explosive of the group consisting of 1,3,5-trinitro-1,3,5-triazacyclohexane (RDX) and 1,3,5,7-tetranitro-1,3,5,7-tetraazacyclooctane (HMX).

and 0.05 to 10% of said elastomer, based on the TNT content of the explosive composition.

3. A castable explosive composition according to claim 2, wherein the amount of TNT is about 40% and the amount of RDX or HMX is about 60%.

4. A castable explosive composition according to claim 2, wherein the elastomer is the reaction product of (a) a hydroxy terminated polyester of a saturated aliphatic glycol of from 4 to 10 carbon atoms and a dicarboxylic acid of the formula HOOC—R—COOH, wherein R is an alkylene radical of 2 to 8 carbon atoms, (b) a saturated aliphatic glycol of from 4 to 10 carbon atoms, and (c) a diphenylmethane diisocyanate.

5. A castable explosive composition according to claim 2, wherein the organic diisocyanate is 2,4-toluene diisocyanate or 4,4'-diphenylmethane diisocyanate.

6. A castable explosive composition according to claim 2, wherein the polyester is a poly (caprolactone) glycol.

7. A castable explosive composition according to claim 4, wherein the elastomer is the reaction product of poly (tetramethyleneadipate) glycol, 1,4-butanediol, and 4,4'-diphenylmethane diisocyanate.

8. A castable explosive composition according to claim 2, wherein the amount of the elastomer is about from 0.1 to 5%.

9. A castable explosive composition according to claim 1 or 2 wherein the elastomer is the reaction product of an organic diisocyanate and a hydroxy terminated polyester.

* * * * *